US010186368B2

(12) United States Patent
Takagi et al.

(10) Patent No.: US 10,186,368 B2
(45) Date of Patent: Jan. 22, 2019

(54) COIL COMPONENT AND TERMINAL COMPONENT USED THEREIN

(71) Applicant: TDK CORPORATION, Tokyo (JP)

(72) Inventors: Nobuo Takagi, Tokyo (JP); Setu Tsuchida, Tokyo (JP); Koji Shimura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 101 days.

(21) Appl. No.: 15/356,928

(22) Filed: Nov. 21, 2016

(65) Prior Publication Data

US 2017/0069420 A1 Mar. 9, 2017

Related U.S. Application Data

(63) Continuation of application No. 14/624,442, filed on Feb. 17, 2015, now Pat. No. 9,543,071.

(30) Foreign Application Priority Data

Feb. 19, 2014 (JP) ..... 2014-029448

(51) Int. Cl.

| | |
|---|---|
| ***H01F 27/29*** | (2006.01) |
| ***H01F 27/30*** | (2006.01) |
| ***H01F 27/28*** | (2006.01) |
| *H01F 17/04* | (2006.01) |

(52) U.S. Cl.

CPC ..... *H01F 27/292* (2013.01); *H01F 27/2828* (2013.01); *H01F 27/29* (2013.01); *H01F 27/30* (2013.01); *H01F 17/045* (2013.01)

(58) Field of Classification Search

CPC ..... H01F 5/00; H01F 27/00–27/36
USPC ..... 336/65, 83, 192, 200, 232–233
See application file for complete search history.

(56) References Cited

U.S. PATENT DOCUMENTS

| | | | | |
|---|---|---|---|---|
| 6,027,008 | A | 2/2000 | Toi et al. | |
| 2004/0145442 | A1 | 7/2004 | Natsutani et al. | |
| 2006/0232173 | A1 * | 10/2006 | Kobane ..... | F02M 47/027 310/366 |
| 2011/0235232 | A1 | 9/2011 | Takeuchi et al. | |

FOREIGN PATENT DOCUMENTS

| | | | |
|---|---|---|---|
| JP | 11340053 | A * | 12/1999 |
| JP | 2003-022916 | | 1/2003 |
| JP | 2005294618 | A * | 10/2005 |
| JP | 2007305665 | | 11/2007 |
| JP | 2009-158777 | | 7/2009 |
| JP | 2013-120919 | | 6/2013 |

* cited by examiner

*Primary Examiner* — Tuyen Nguyen
(74) *Attorney, Agent, or Firm* — Young Law Firm, P.C.

(57) ABSTRACT

Disclosed herein is a coil component that includes a base, a metal wire that is wound around the base and contains copper, and a terminal electrode that is provided on the base and contains nickel and tin. The terminal electrode includes a wire connection area to which an end portion of the metal wire is connected and which contains a CuNi alloy or a CuNiSn alloy, and a mounting area which is different from the wire connection area. The wire connection area includes a portion that contains a small amount of tin than the mounting area.

16 Claims, 7 Drawing Sheets

COIL COMPONENT AND TERMINAL COMPONENT USED THEREIN

BACKGROUND OF THE INVENTION

Field of the Invention

The present invention relates to a coil component, and particularly to a coil component that includes a metal wire containing copper (Cu) and a terminal electrode containing nickel (Ni) and tin (Sn). Moreover, the present invention relates to a terminal component that is used as a terminal electrode of such a coil component.

Description of Related Art

In recent years, small coil components that can be surface-mounted have been frequently used in various electronic devices. Coil components of this kind include a metal wire that is wound around a base, and an end portion of the metal wire is connected to a terminal electrode.

As the terminal electrode, a terminal fitting that has a tin plating on a nickel plating may be used as disclosed in Japanese Patent Application Laid-open No. 2009-158777. The nickel plating prevents a base material of the terminal fitting that is made of copper from coming in contact with the tin plating. The tin plating ensures the wettability of solder at the time of mounting.

As a method of bonding a metal wire on the terminal fitting, as disclosed in Japanese Patent Application Laid-open No. 2003-22916, a thermocompression bonding method is widely used. With the thermocompression bonding method, a CuNi alloy may be formed in the wire connection portion when the metal wire is made of copper. As a result, the terminal fitting and the metal wire are firmly bonded together.

However, if the wire connection portion of the terminal fitting contains a large amount of tin, a Cu—Sn alloy can be easily formed. Depending on the component proportion ratio thereof, the alloy may be melted by heat during reflow or any other process, for example. In some cases, the metal wire could drop off from the wire connection portion.

Such a problem would similarly arise not only when the base material of the terminal fitting is made of metal material but also when the base material of the terminal fitting is made of resin. Furthermore, such a problem could similarly arise not only when the terminal fitting is used but also when a terminal electrode that is formed by plating on a surface of a base of a coil component is used.

SUMMARY

It is therefore an object of the present invention to provide a coil component that has improved in bonding strength between the metal wire and the terminal fitting or the terminal electrode.

Another object of the present invention is to provide a terminal component that is a terminal component for a coil component and which can be bonded firmly to the metal wire.

A coil component of the present invention includes: a base; a metal wire that is wound around the base and contains copper; and a terminal electrode that is provided on the base and contains nickel and tin, wherein the terminal electrode includes a wire connection area to which an end portion of the metal wire is connected and which contains a CuNi alloy or a CuNiSn alloy, and a mounting area which is different from the wire connection area, and the wire connection area includes a portion that contains a small amount of tin than the mounting area. The average amount of tin contained in the entire wire connection area, or the amount of tin contained per unit area in the wire connection area, is less than the average amount of tin contained in the entire mounting area, or the amount of tin contained per unit area in the mounting area.

A terminal component of the present invention that contains nickel and tin and to which an end portion of a metal wire included in a coil component is connected has: a wire connection area to which the end portion of the metal wire is connected; and a mounting area that is soldered at the time of mounting the coil component, wherein an amount of tin contained in the wire connection area is lower than an amount of tin contained in the mounting area.

According to the present invention, the wire connection area contains less tin than the mounting area. Therefore, it is possible to reduce the amount of tin getting into a CuNi alloy, which is formed by thermocompression bonding of the metal wire. Thus, it is possible to ensure a sufficient bonding strength even during reflow. Moreover, the mounting area contains a larger amount of tin. Therefore, it is possible to ensure the wettability of solder at the time of mounting.

According to the present invention, the mounting area is preferably formed in such a way that a surface of a nickel layer is covered with a tin layer. This configuration ensures the wettability of solder at the time of mounting. Moreover, even if an underlying layer of the nickel layer is made of copper, it is possible to prevent so-called copper erosion.

According to the present invention, the wire connection area is preferably formed in such a way that a surface of a nickel layer is covered with a tin layer, and a thickness of the tin layer in the wire connection area is less than a thickness of the tin layer in the mounting area. This configuration makes it possible to control the amount of tin contained by controlling the thickness of the tin layer.

In this case, the thickness of the tin layer in the wire connection area is preferably less than 1.2 μm, and the thickness of the tin layer in the mounting area is greater than 1.2 μm. This is because the results of experiment have proved that the bonding strength is at the lowest level when the tin layer is about 1.2 μm in thickness.

According to the present invention, it is also preferred that the wire connection area substantially contains no tin. According to this configuration, since the amount of tin contained in the CuNi alloy is almost zero, a high bonding strength can be ensured.

According to the present invention, the wire connection area preferably covers a first surface of the base, and the mounting area covers a second surface that is perpendicular to the first surface of the base. According to this configuration, the terminal electrode does not protrude from the base. Therefore, the coil component can be made smaller in size.

According to the present invention, the terminal electrode preferably includes a base material, a nickel layer that is provided on a surface of the base material, and a tin layer that covers the nickel layer, and the terminal electrode is a terminal component that is fixed to the base of the coil component. According to this configuration, there is no need to perform plating on the base of the coil component. Therefore, it is possible to cut production costs.

According to the present invention, it is possible to provide a coil component that has improved in bonding strength between the metal wire and the terminal electrode. Moreover, according to the present invention, it is possible to provide a terminal component that is a terminal component for a coil component and which can be bonded firmly to the metal wire.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
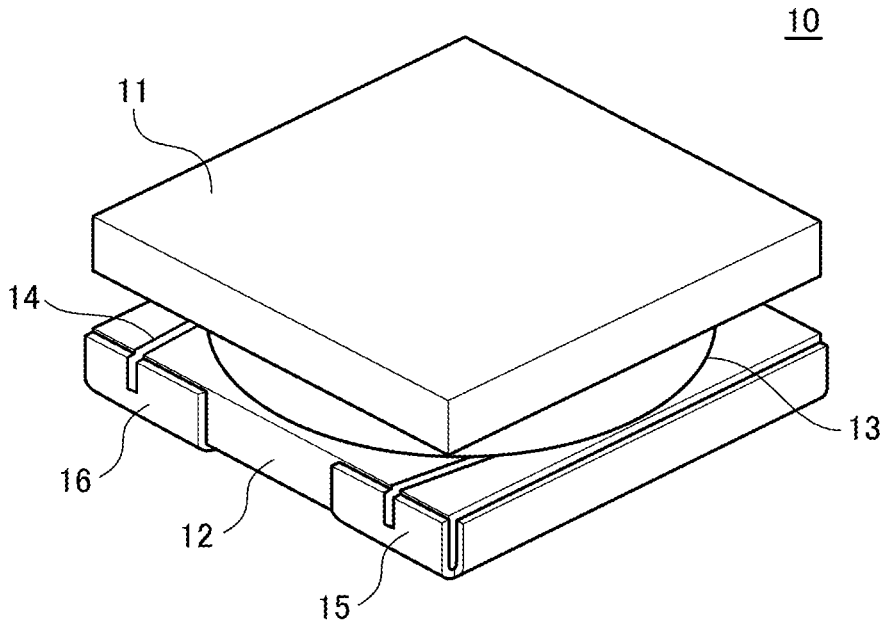
FIG. 1 is a perspective view illustrating the configuration of a coil component according to a preferred embodiment of the present invention.
Figure 2:
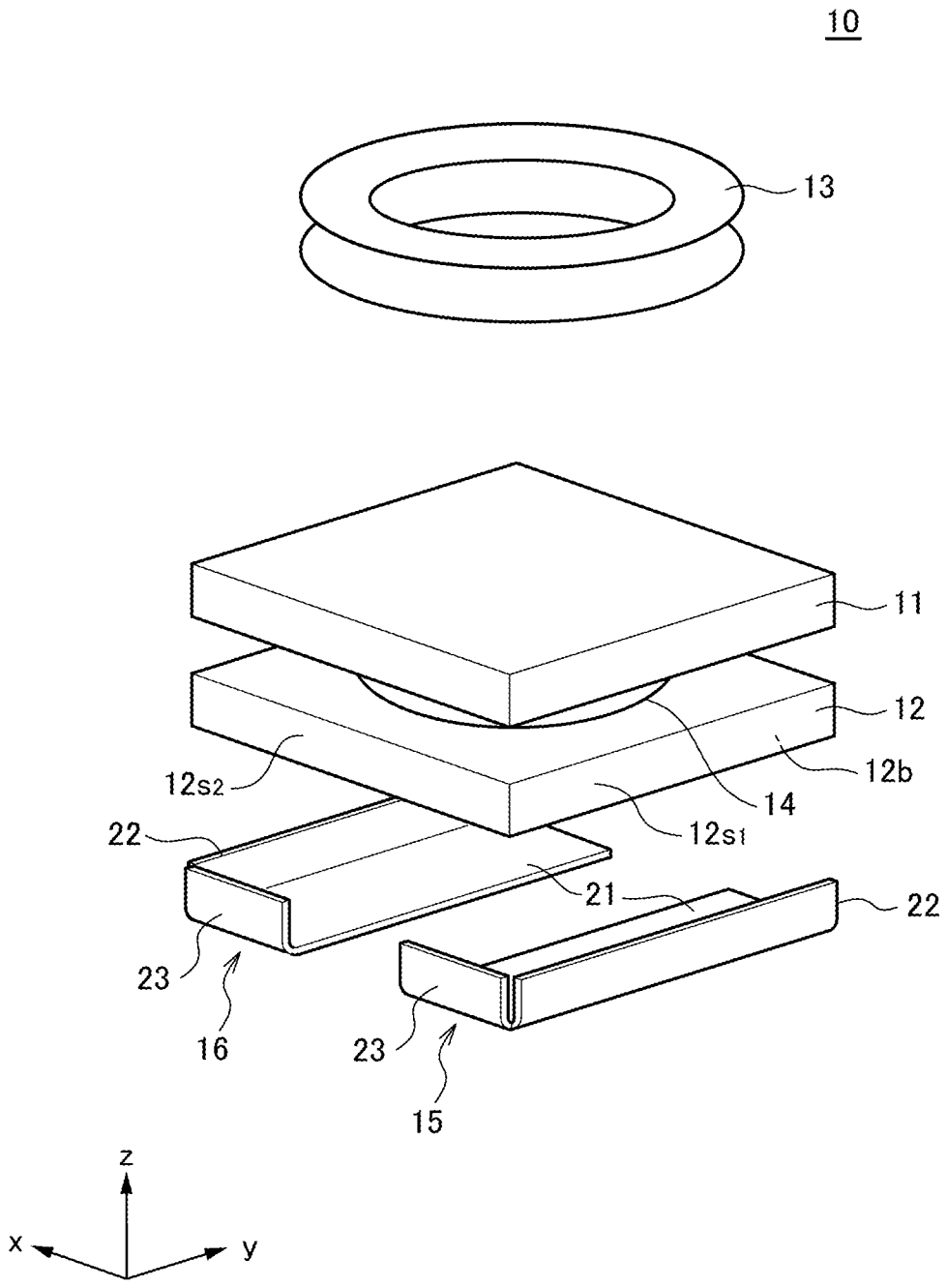
FIG. 2 is an exploded perspective view of the coil component shown in FIG. 1.

FIG. 1 is a perspective view illustrating the configuration of a coil component 10 according to a preferred embodiment of the present invention. FIG. 2 is an exploded perspective view of the coil component 10.

As shown in FIGS. 1 and 2, the coil component 10 of the present embodiment includes two cores that consist of an upper core 11 and a lower core 12, an exterior resin 13 that is housed in the upper core 11 and the lower core 12, a metal wire 14 that is wound around the exterior resin 13, and a pair of terminal components 15 and 16 to which the metal wire 14 is connected.

The upper and lower cores 11 and 12 are made of a magnetic material, such as Ni—Zn ferrite, for example. The exterior resin 13 is applied to concave portions that are formed on the inner surfaces of the upper and lower cores 11 and 12. As the exterior resin 13, a resin to which a magnetic material such as ferrite has been added is preferably used. According to the present embodiment, the upper core 11, the lower core 12, and the exterior resin 13 make up a base of the coil component 10. The metal wire 14 that is wounded around the exterior resin 13 is a coated conductor wire whose core material is made of copper (Cu). One end of the metal wire 14 is connected to one terminal component 15, and the other end is connected to the other terminal component 16.

The terminal components 15 and 16 are metal parts that are made by bending a metal plate whose base material is copper. The terminal components 15 and 16 are bonded and fixed to the lower core 12. More specifically, as shown in FIG. 2, the terminal components 15 and 16 each include a first mounting area 21, a second mounting area 22, and a wire connection area 23.

The first mounting area 21 is an area that constitutes an xy-plane. The first mounting area 21 is disposed in such a way as to cover a bottom surface 12*b* of the lower core 12. The second mounting area 22 is an area that constitutes a yz-plane. The second mounting area 22 is disposed in such a way as to cover a side surface $\mathbf{12}s_1$ of the lower core 12. The wire connection area 23 is an area that constitutes an xz-plane. The wire connection area 23 is disposed in such a way as to cover a side surface $\mathbf{12}s_2$ of the lower core 12. In this manner, the terminal components 15 and 16 each have three surfaces that are substantially perpendicular to each other, and the three surfaces cover three surfaces of the lower core 12 that are substantially perpendicular to each other. Therefore, the terminal components 15 and 16 do not protrude significantly from the base, and the coil component 10 can be smaller in size.

Figures 3A, 3B, 3C:
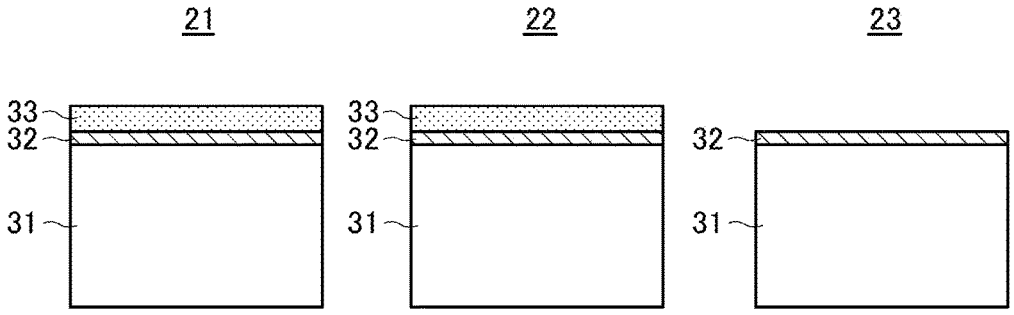
FIG. 3A is a diagram showing a cross-sectional structure of a first mounting area of terminal components.
FIG. 3B is a diagram showing a cross-sectional structure of a second mounting area of the terminal components.
FIG. 3C is a diagram showing a cross-sectional structure of a wire connection area of the terminal components.

FIGS. 3A to 3C are diagrams showing the cross-sectional structures of the terminal components 15 and 16. FIG. 3A shows a cross-section of the first mounting area 21. FIG. 3B shows a cross-section of the second mounting area 22. FIG. 3C shows a cross-section of the wire connection area 23.

As shown in FIGS. 3A and 3B, the mounting areas 21 and 22 of the terminal components 15 and 16 each include a nickel layer 32 that is provided on a surface of a base material 31 made of copper, and a tin layer 33 that covers the nickel layer 32. The tin layer 33 is exposed to an outer surface, and ensures the wettability of solder at the time of mounting. The nickel layer 32 prevents the base material 31 made of copper from coming in contact with the tin layer 33, thereby preventing so-called copper erosion.

As shown in FIG. 3C, the wire connection areas 23 of the terminal components 15 and 16 do not have the tin layer 33. That is, the nickel layer 32 is being exposed to an outer surface. The reason why the tin layer 33 is eliminated from the wire connection areas 23 is to prevent tin from getting into a CuNi alloy when thermocompression bonding of the metal wire 14 is performed.

Figure 4:
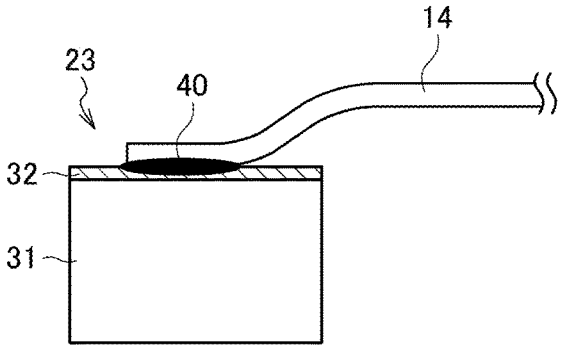
FIG. 4 is a diagram showing the state that a metal wire is connected to the wire connection area.

When the metal wire 14 is connected by thermocompression bonding, as shown in FIG. 4, a CuNi alloy 40 is formed from the copper that is the core material of the metal wire 14, and the nickel that is exposed to the wire connection area 23. The melting point of the CuNi alloy 40 is high. Therefore, a sufficient bonding strength of the metal wire 14 can be ensured even during reflow. If tin got into the CuNi alloy 40, the bonding strength would have been lowered. According to the present embodiment, however, the tin layer 33 is not provided in the wire connection area 23. Therefore, tin is unlikely to get into the CuNi alloy 40. Therefore, a sufficient bonding strength can be ensured.

Figure 5:
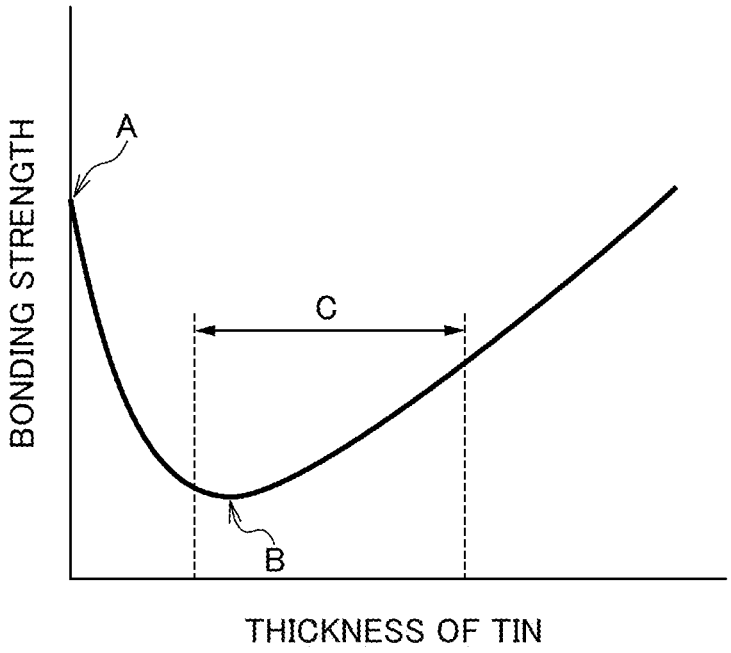
FIG. 5 is a graph illustrating the relationship between the thickness of a tin layer and the bonding strength measured after thermocompression bonding.

FIG. 5 is a graph illustrating the relationship between the thickness of the tin layer 33 and the bonding strength measured after thermocompression bonding.

As shown in FIG. 5, if the thickness of the tin layer 33 is zero (as indicated by reference symbol A), a high bonding strength can be obtained. However, the bonding strength drops as the thickness of the tin layer 33 increases. The reason is that, as the thickness of the tin layer 33 increases, the amount of tin contained per unit area increases, resulting in an increase in the amount of tin getting into the CuNi alloy and thereby leading to the formation of a CuNiSn alloy.

This trend continues until the thickness reaches a level indicated by reference symbol B. Once the thickness of the tin layer 33 exceeds that level, the bonding strength becomes higher as the thickness of the tin layer 33 increases. The reason is that, once the amount of tin becomes greater than or equal to a certain level, the metal wire 14 is being covered with the tin and supported by the tin. Therefore, after the thickness exceeds the level indicated by reference symbol B, the bonding strength grows as the amount of tin increases.

However, the thicker tin layer 33 requires more time for the tin plating, resulting in a decrease in productivity. Actually, the optimal thickness of the tin layer 33 in the mounting areas 21 and 22 is often within the range indicated by reference symbol C in FIG. 5. If the thickness of the tin layer 33 in the wire connection area 23 is set to that range, the bonding strength of the metal wire 14 may be insufficient. To increase the bonding strength, the thickness of the tin layer 33 in the wire connection area 23 may be set greater than the range of reference symbol C. However, in this case, the productivity is lowered as described above.

In contrast, according to the present embodiment, in the wire connection area 23, no tin layer 33 is provided. Therefore, the bonding strength is at the level indicated by reference symbol A as shown in FIG. 5. In this manner, without performing plating for a long time, a high bonding strength can be ensured. Moreover, the tin layer 33 exists in the mounting areas 21 and 22. Therefore, the wettability of solder can be ensured at the time of mounting.

Figure 6:
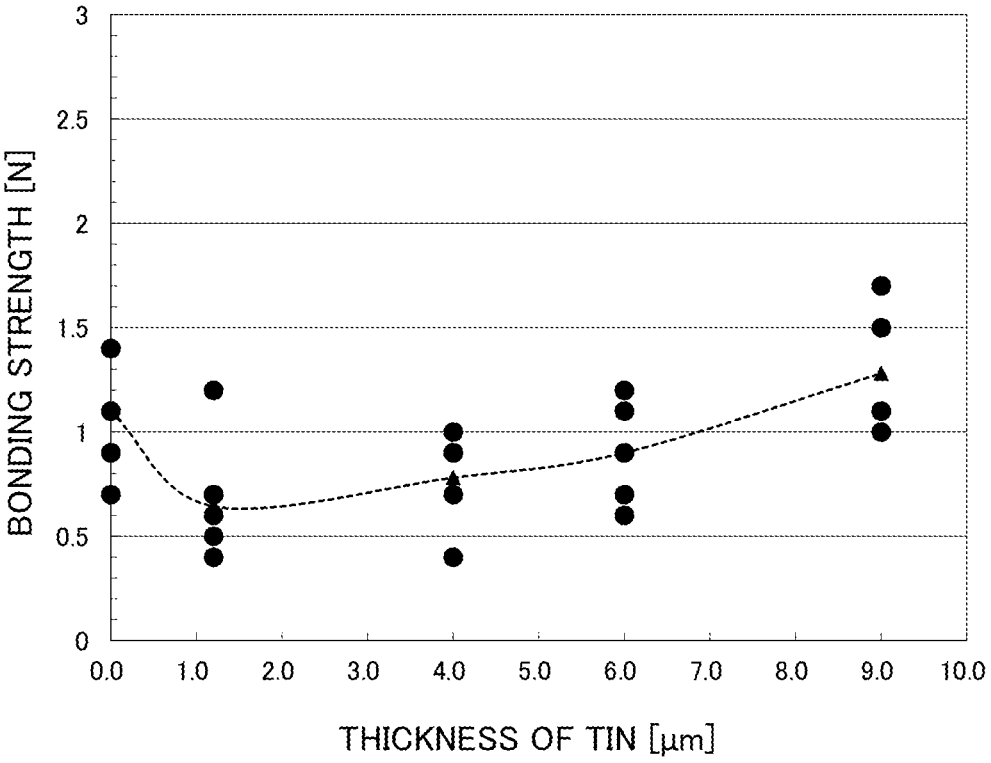
FIG. 6 is a graph showing measured values of the relationship between the thickness of the tin layer and the bonding strength measured after thermocompression bonding.

FIG. 6 is a graph showing measured values of the relationship between the thickness of the tin layer 33 and the bonding strength measured after thermocompression bonding.

Data shown in FIG. 6 shows the bonding strength measured after thermocompression bonding where a plurality of samples in which the tin layers 33 formed on the surfaces of the nickel layers 32 were 0 μm, 1.2 μm, 4 μm, 6 μm, and 9 μm in thickness were prepared, and then the thermocompression bonding of the metal wire 14 made of copper with a load of 20 N was performed on each sample. The measured values are plotted with mark "●". The average values of bonding strength for each thickness are plotted with mark "▲". In the measurement of the bonding strength, the load was applied to the metal wire 14 in a direction in which the metal wire 14 might be peeled after the thermocompression bonding. The load that was recorded at a time when the metal wire 14 was actually peeled off was regarded as the bonding strength.

As shown in FIG. 6, according to the measured values, the bonding strength was at the weakest level when the thickness of the tin layer 33 was 1.2 μm. Therefore, according to the measured values, it is preferred that the thickness of the tin layer 33 in the wire connection area 23 be less than 1.2 μm. Meanwhile, in the mounting areas 21 and 22, in order to ensure the sufficient wettability of solder, the thickness of the tin layer 33 may be set to about 3 μm to 5 μm.

Figure 7:
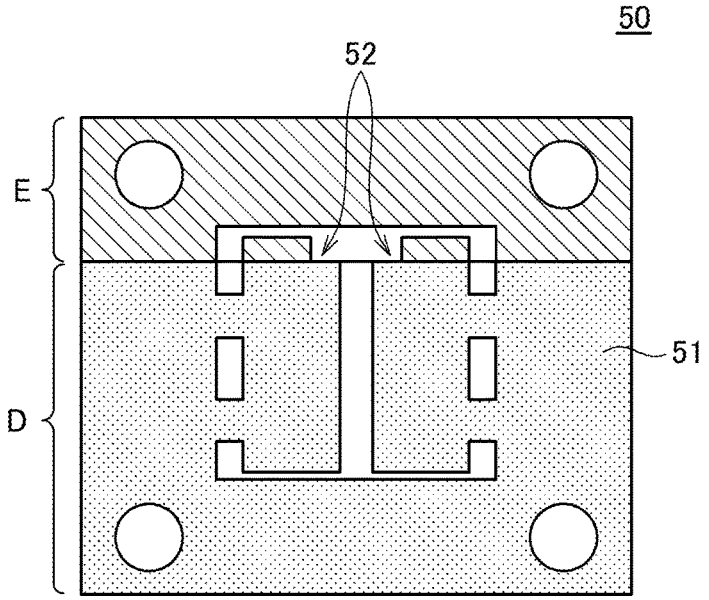
FIG. 7 is a diagram illustrating a method of producing the terminal components.

FIG. 7 is a diagram illustrating a method of producing the terminal components 15 and 16.

As shown in FIG. 7, a lead frame 50 which is made of copper is used in producing the terminal components 15 and 16. In the example shown in FIG. 7, two terminal components 15 and 16 can be produced from one lead frame 50. The lead frame 50 includes a frame-shaped area 51 and two terminal areas 52, those components exist as one unit during the production process. One surface of the lead frame 50 is then plated with nickel and then with tin. The nickel plating is performed in such a way as to cover the entire area of one surface of the lead frame 50. The tin plating is performed with part of the surface being masked. A region indicated by reference symbol D in FIG. 7 is a region that is plated with tin. A region indicated by reference symbol E is a region that is not plated with tin because the region is masked.

After being cut from the frame-shaped area 51, the two terminal areas 52 are bent. As a result, the two terminal components 15 and 16 are completed. In this manner, the terminal components 15 and 16 can be made.

In the embodiment described above, no tin layer 33 is provided in the wire connection area 23. Therefore, the wire connection area substantially does not contain tin. The phrase "substantially does not contain tin" means that a small amount of tin that is contained unintentionally is tolerated. When the wire connection area substantially does not contain tin, the metal wire 14 made of copper is high in bonding strength. However, the nickel layer 32 is being exposed. Therefore, after being left for a long time, the nickel layer 32 might be oxidized. In order to prevent the oxidization of the nickel layer 32, the surface of the nickel layer 32 can be covered with other metals. As the metal that covers the surface of the nickel layer 32, a thin coating of tin may be applied. In this case, however, the thickness of the tin layer 33 provided in the wire connection area 23 needs to be less than the thickness of the tin layer 33 in the mounting areas 21 and 22.

Figures 8A, 8B, 8C:
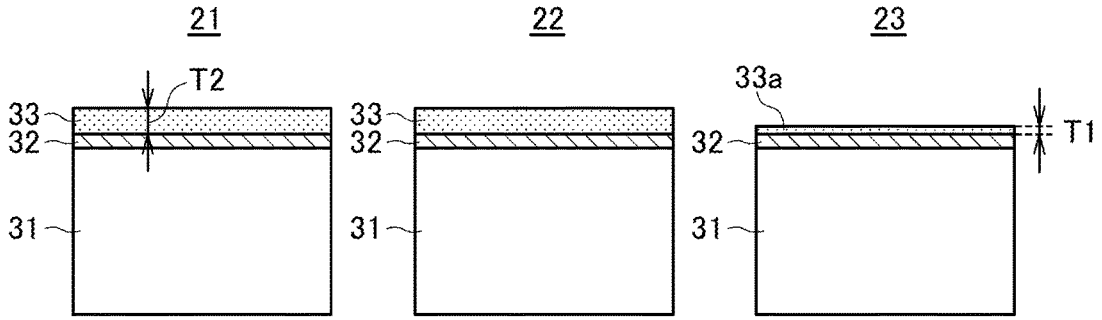
FIG. 8A is a diagram showing a cross-sectional structure of a first mounting area of terminal components according to a modified example.
FIG. 8B is a diagram showing a cross-sectional structure of a second mounting area of the terminal components according to the modified example.
FIG. 8C is a diagram showing a cross-sectional structure of a wire connection area of the terminal components according to the modified example.

FIGS. 8A to 8C are diagrams showing the cross-sectional structures of terminal components 15 and 16 according to a modified example. FIG. 8A shows a cross-section of a first mounting area 21. FIG. 8B shows a cross-section of a second mounting area 22. FIG. 8C shows a cross-section of a wire connection area 23.

In the modified example shown in FIGS. 8A and 8B, the cross-sections of the mounting areas 21 and 22 are identical to those shown in the example of FIGS. 3A and 3B. However, on the surface of the wire connection area 23, a thin tin layer 33*a* is provided as shown in FIG. 8C. Accordingly, after the metal wire 14 is connected, a CuNi alloy or a CuNiSn alloy, or both, may be formed in the wire connection area 23. Thickness T1 of the tin layer 33*a* is less than thickness T2 of the tin layer 33 in the mounting areas 21 and 22 (T1<T2). Moreover, the thickness T1 is less than the thickness indicated by reference symbol B in FIG. 5, and the thickness T2 is greater than the thickness indicated by reference symbol B in FIG. 5. This configuration minimizes the amount of tin getting into the CuNi alloy in the wire connection area 23, and also minimizes a decrease in the bonding strength associated with the generation of the CuNiSn alloy. In the mounting areas 21 and 22, the sufficient wettability of solder can be ensured.

Incidentally, if the thin tin layer 33*a* is provided in the wire connection area 23 as described in the modified example shown in FIG. 8, the connected metal wire 14 is covered with melted tin after thermocompression bonding of the metal wire 14. As a result, some portions of the tin layer 33*a* might be thick. Even in such a case, the other portions of the wire connection area 23 still contain less tin than the mounting areas 21 and 22. Therefore, it can be sufficiently confirmed that the tin layer 33*a* is thin before the wire is connected. In this manner, before the wire is connected, the thickness of the tin layer 33*a* in any part of the wire connection area 23 is less than the thickness of the tin layer 33 in any part of the mounting areas 21 and 22. However, after the wire is connected, the thickness of tin varies.

Therefore, even if some portions of the tin layer 33*a* in the wire connection area 23 are thick, such a configuration is within the scope of the present invention as long as it is obvious that the thickness of the tin layer 33*a* is less than the thickness of the tin layer 33 before the wire is connected.

It is apparent that the present invention is not limited to the above embodiments, but may be modified and changed without departing from the scope and spirit of the invention.

Figure 9:
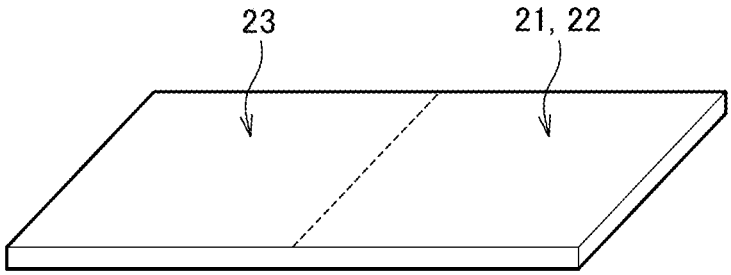
FIG. 9 is a perspective view showing the configuration of a terminal component according to a modified example.

For example, the shape of the terminal components is not limited to those described in the above embodiment. As shown in FIG. 9, the mounting areas 21 and 22 and the wire connection area 23 may be on the same plane. That is, regardless of whether or not there is a bent portion, all that is required is for the mounting areas 21 and 22 and the wire connection area 23 to exist on a continuous plane.

The base material of the terminal components may not necessarily be made of metal. Alternatively, a base material made of resin may be used.

Components that are attached afterward to the base of the coil component, such as the terminal components, may not necessarily be used. Instead of the terminal components, a terminal electrode formed by plating on the base of the coil component may be used.

The coil component of the present invention is not limited to the coil component of the shape described in the above embodiment. Coil components of other shapes, such as a coil component that uses a drum-type core, may be used. Moreover, the number of metal wires is not limited. The coil component may have two or more metal wires.

What is claimed is:

1. A terminal component that contains nickel and tin, the terminal component comprising:

a wire connection area to which an end portion of a metal wire included in a coil component is to be connected; and a mounting area that is to be soldered at a time of mounting the coil component, wherein an amount of tin contained in the wire connection area is lower than an amount of tin contained in the mounting area.

2. The terminal component as claimed in claim 1, wherein the mounting area comprises a tin layer that covers a nickel layer.

3. The terminal component as claimed in claim 2, wherein the wire connection area comprises a tin layer that covers a nickel layer, and a thickness of the tin layer in the wire connection area is less than a thickness of the tin layer in the mounting area.

4. The terminal component as claimed in claim 3, wherein the thickness of the tin layer in the wire connection area is less than 1.2 μm, and the thickness of the tin layer in the mounting area is greater than 1.2 μm.

5. The terminal component as claimed in claim 1, wherein the wire connection area is substantially free from tin.

6. The terminal component as claimed in claim 1, wherein the wire connection area is substantially perpendicular to the mounting area.

7. The terminal component as claimed in claim 1, wherein the terminal electrode includes:

a base material;

a nickel layer that covers the base material; and a tin layer that covers the nickel layer.

8. The terminal component as claimed in claim 6, wherein the wire connection area covers a first surface of the coil component, and the mounting area covers a second surface of the coil component.

9. The terminal component as claimed in claim 1, further comprising another mounting area that is substantially perpendicular to each of the mounting area and the wire connection area, and wherein an amount of tin contained in the wire connection area is lower than an amount of tin contained in the another mounting area.

10. A terminal component comprising:

a base material;

a nickel layer that covers the base material; and a tin layer that covers the nickel layer, wherein the base material includes a first area and a second area substantially perpendicular to the first area, and wherein the tin layer on the first area is thinner than the tin layer on the second area.

11. The terminal component as claimed in claim 10, wherein the base material further includes a third area substantially perpendicular to each of the first and second areas.

12. The terminal component as claimed in claim 11, wherein the tin layer on the first area is thinner than the tin layer on the third area.

13. A terminal component comprising:

a first plane area extending in a first direction and a second direction perpendicular to the first direction;

a second plane area extending in a first direction and a third direction perpendicular to the first and second directions;

a third plane area extending in the second direction and the third direction;

a first vertically folded portion located between the first and second areas; and a second vertically folded portion located between the first and third areas, wherein each of the first, second and third plane areas includes a base material, a nickel layer that covers the base material, and a tin layer that covers the nickel layer, and wherein the tin layer in the third plane area is thinner than the tin layer in the first and second plane areas.

14. The terminal component as claimed in claim 13, wherein the first vertically folded portion extends in the first direction, and wherein the second vertically folded portion extends in the second direction.

15. The terminal component as claimed in claim 13, wherein each of the first, second and third plane areas is a rectangular-shaped.

16. The terminal component as claimed in claim 13, wherein a thickness of the tin layer in the third plane area is less than 1.2 μm, and a thickness of the tin layer in the first and second plane areas is greater than 1.2 μm.

* * * * *